US006530223B1

(12) United States Patent
Dodds et al.

(10) Patent No.: US 6,530,223 B1
(45) Date of Patent: Mar. 11, 2003

(54) MULTI-STAGE RADIAL AXIAL GAS TURBINE ENGINE COMBUSTOR

(75) Inventors: Willard J. Dodds, West Chester, OH (US); Paul V. Heberling, Lawrenceburg, IN (US); Jack R. Taylor, Cincinnati, OH (US); Ely E. Halila, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/398,557

(22) Filed: Sep. 17, 1999

Related U.S. Application Data

(60) Provisional application No. 60/103,650, filed on Oct. 9, 1998, and provisional application No. 60/103,649, filed on Oct. 9, 1998.

(51) Int. Cl.[7] ..... F02C 1/00

(52) U.S. Cl. ..... 60/746; 60/39.826; 60/748

(58) Field of Search ..... 60/748, 737, 738, 60/746, 39.826, 733

(56) References Cited

U.S. PATENT DOCUMENTS 5,444,982 A 8/1995 Heberling et al. ..... 60/737
5,490,380 A * 2/1996 Marshall ..... 60/39.06
5,540,056 A 7/1996 Heberling et al. ..... 60/737
5,596,873 A 1/1997 Joshi et al. ..... 60/738
5,619,855 A 4/1997 Burrus ..... 60/736
5,682,747 A * 11/1997 Brown et al. ..... 60/746
5,749,219 A * 5/1998 Dubell ..... 60/39.36
5,791,148 A 8/1998 Burrus ..... 60/752

OTHER PUBLICATIONS

"HSCT Computer Model Takes Shape at NASA," pp. 68–76, by James Ott, Hampton, VA, in Aviation Week & Space Technology, Oct. 13, 1997.

* cited by examiner

*Primary Examiner*—Charles G. Freay
*Assistant Examiner*—William Rodriguez
(74) *Attorney, Agent, or Firm*—Andrew C. Hess; William Scott Andes

(57) ABSTRACT

A combustor for a gas turbine engine having a longitudinal axis therethrough, including an outer liner having a forward end and an aft end, an inner liner having a forward end and an aft end, a first dome formed upstream of the outer liner forward end so as to define a first combustion zone radially oriented to the longitudinal axis, and a dome plate having an outer portion connected to an upstream end of the first dome and an inner portion connected to the inner liner forward end, wherein a second combustion zone is defined by the dome plate, the outer liner, and the inner liner substantially perpendicular to the first combustion zone.

26 Claims, 6 Drawing Sheets

MULTI-STAGE RADIAL AXIAL GAS TURBINE ENGINE COMBUSTOR

CROSS-REFERENCE TO RELATED APPLICATIONS

This application is related to provisional applications having Ser. Nos. 60/103,650 and 60/103,649, both filed on Oct. 9, 1998.

STATEMENT REGARDING FEDERALLY SPONSORED RESEARCH AND DEVELOPMENT

The U.S. Government may have certain rights in this invention pursuant to contract number NAS3-26617.

BACKGROUND OF THE INVENTION

The present invention relates generally to combustors in gas turbine engines and, in particular, to a gas turbine engine combustor having a pilot dome oriented in substantially perpendicular relation to a main dome.

It will be appreciated that emissions are a primary concern in the operation of gas turbine engines, particularly with respect to the impact on the ozone layer by nitrous oxides (NOx), carbon monoxide (CO), and hydrocarbons. In the case of supersonic commercial transport aircraft flying at high altitudes, current subsonic aircraft technology is not applicable given the detrimental effects on the stratospheric ozone. Accordingly, new fuel injection and mixing techniques have been and continue to be developed in order to provide ultra-low NOx at all engine operating conditions.

One combustion system, known as a dry low emission (DLE) combustor, premixes fuel and air in a manner so that the fuel-air ratios are below stoichiometric levels (also known as "lean"). The DLE combustor is described in greater detail in U.S. Pat. Nos. 5,675,971 and 5,680,766, for example, and falls generally within a class of gas turbine engine combustors known as lean, premixed, prevaporized (LPP). While the DLE combustor is able to produce ultra-low NOx across a broad range of conditions for stationary land-based operations, it is a heavy and relatively complex system. Thus, such DLE design was found to be unacceptable for use in aircraft engines due to cost and weight considerations.

Further, a key component found to provide extremely low levels of NOx at moderate to high power conditions for such aircraft engine was the use of a series of simple mixing tubes as the main fuel injection source. It was found, however, that flame stability and emissions characteristics of a combustor incorporating only such mixing tubes was less capable at low power. Thus, it was determined that an independent pilot fuel injector system would be beneficial for such combustor to improve low power flame stability and meet landing-takeoff (LTO) and idle cycle emissions requirements.

The use of combustion staging has been in practice within the gas turbine engine art for many years to expand the operational range of combustion systems, as well as to provide a broad range of gas turbine power output and applicability. This has typically been accomplished by staging the fuel in a plurality of fuel air mixing devices or modulating the mixing devices independently. In addition, air staging has been performed by having separate and/or isolated annular or cannular combustion zones that can be controlled independently to provide low emissions and a broad range of operation. To date, however, such staging by pilot and main combustion zones has been within substantially the same annular plane.

In light of the foregoing, it would be desirable for a gas turbine engine combustor to be developed which provides ultra-low emissions during all operating conditions. It would also be desirable for such combustor to be simple in construction so as to minimize weight and cost, as well as fit within size parameters available for existing gas turbine engine combustors.

BRIEF SUMMARY OF THE INVENTION

In an exemplary embodiment of the invention, a combustor for a gas turbine engine having a longitudinal axis therethrough is disclosed as including an outer liner having a forward end and an aft end, an inner liner having a forward end and an aft end, a first dome formed upstream of the outer liner forward end so as to define a first combustion zone radially oriented to the longitudinal axis, and a dome plate having an outer portion connected to an upstream end of the first dome and an inner portion connected to the inner liner forward end, wherein a second combustion zone is defined by the dome plate, the outer liner, and the inner liner substantially perpendicular to the first combustion zone.

Further, a plurality of circumferentially spaced fuel air mixers are positioned with respect to a corresponding segment of the first dome so as to provide a swirled fuel air mixture into the first combustion zone. Likewise, a plurality of fuel air mixers are positioned upstream of the dome plate for providing an unswirled fuel air mixture into the second combustion zone. In this way, a vortex flow created in the first combustion zone moves radially inward to mix with the axial flow injected into the second combustion zone. Preferably, the axial flow injected through the dome plate is aligned with an aft component of the vortex flow.

DETAILED DESCRIPTION OF THE INVENTION

Figure 1:
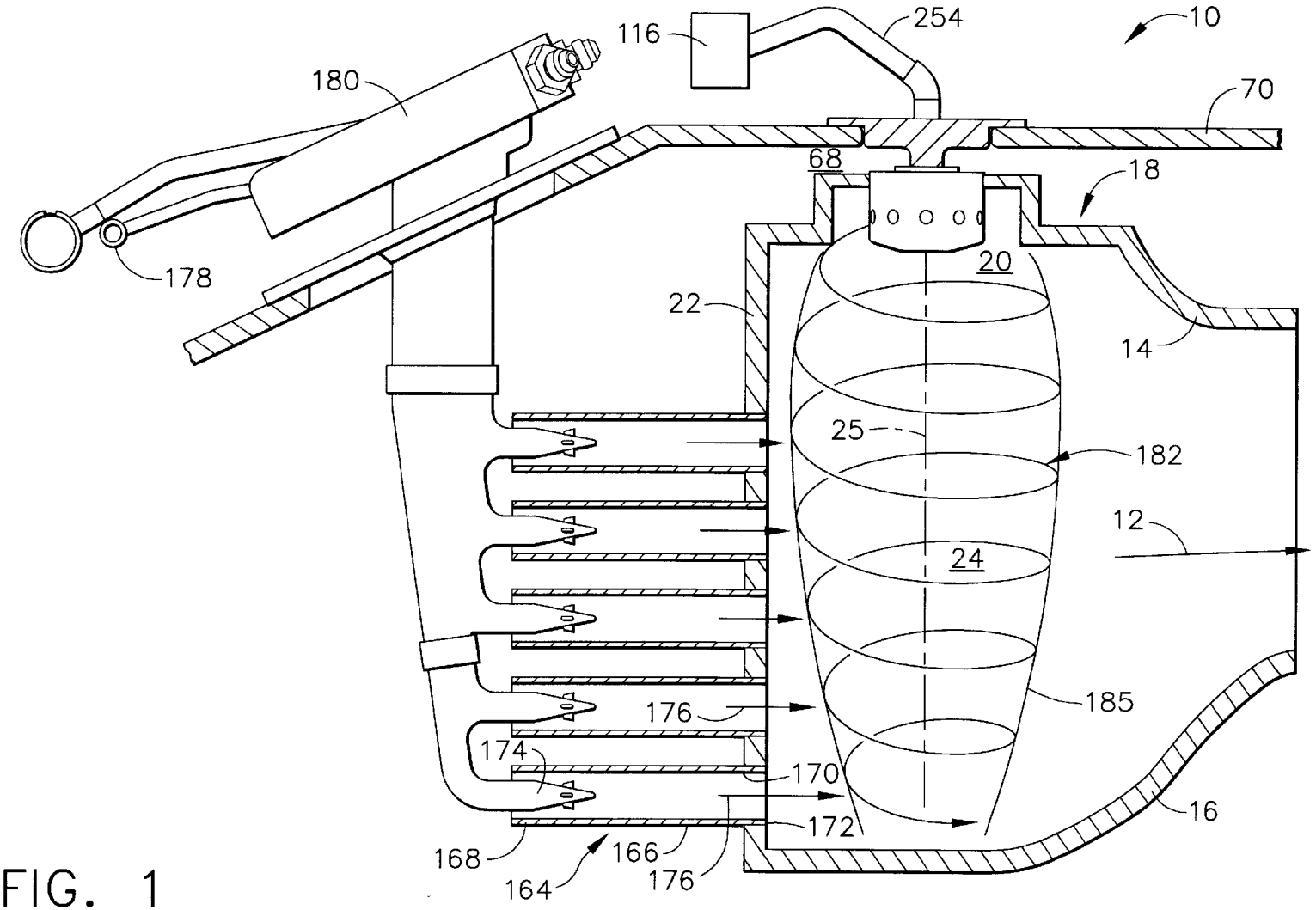
FIG. 1 is a schematic longitudinal cross-sectional view of a gas turbine engine combustor in accordance with the present invention, where a radial vortex flow from the pilot dome and axial flow from the main dome are depicted as entering the main combustion zone.

Referring now to the drawings in detail, wherein identical numerals indicate the same elements throughout the figures, FIG. 1 depicts a gas turbine engine combustor identified generally by reference numeral 10. As seen therein, combustor 10 has a longitudinal axis 12 extending therethrough and includes an outer liner 14, an inner liner 16, a first or pilot dome 18 positioned immediately upstream of outer liner 14 to form a first combustion zone 20 radially oriented to longitudinal axis 12, and a dome plate 22 which is connected to first dome 18 at an outer portion and to inner liner 16 at an inner portion. In this way, a second or main combustion zone 24 is defined by dome plate 22, outer liner 14 and inner liner 16 which is located substantially perpendicular to first combustion zone 20. Of course, it will be appreciated that first dome 18 is positioned axially downstream of dome plate 22 as indicated by a radial axis 25 extending through first dome 18 (see FIG. 1).

Figure 2:
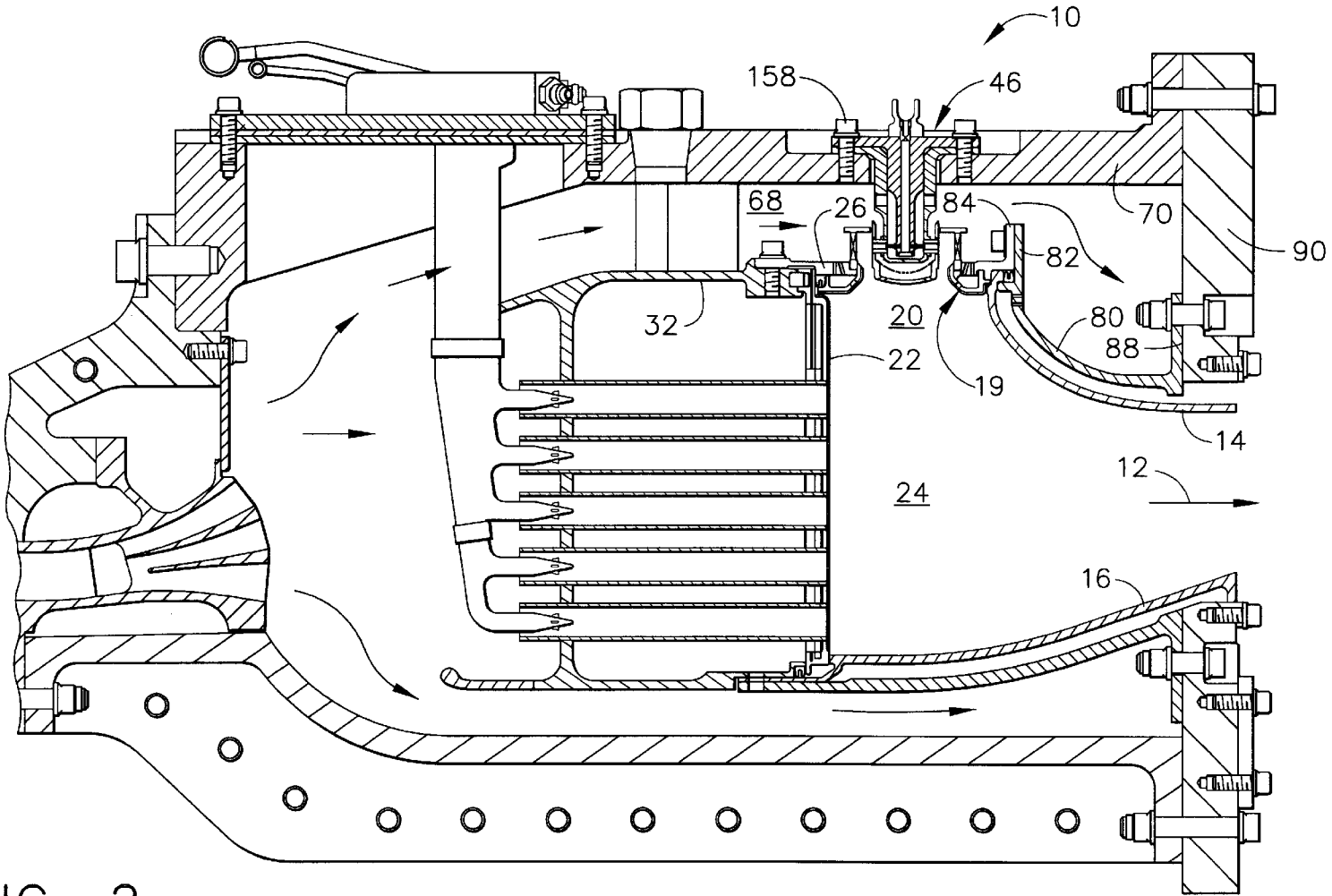
FIG. 2 is a detailed longitudinal cross-sectional view of the combustor depicted in FIG. 1.
Figure 3:
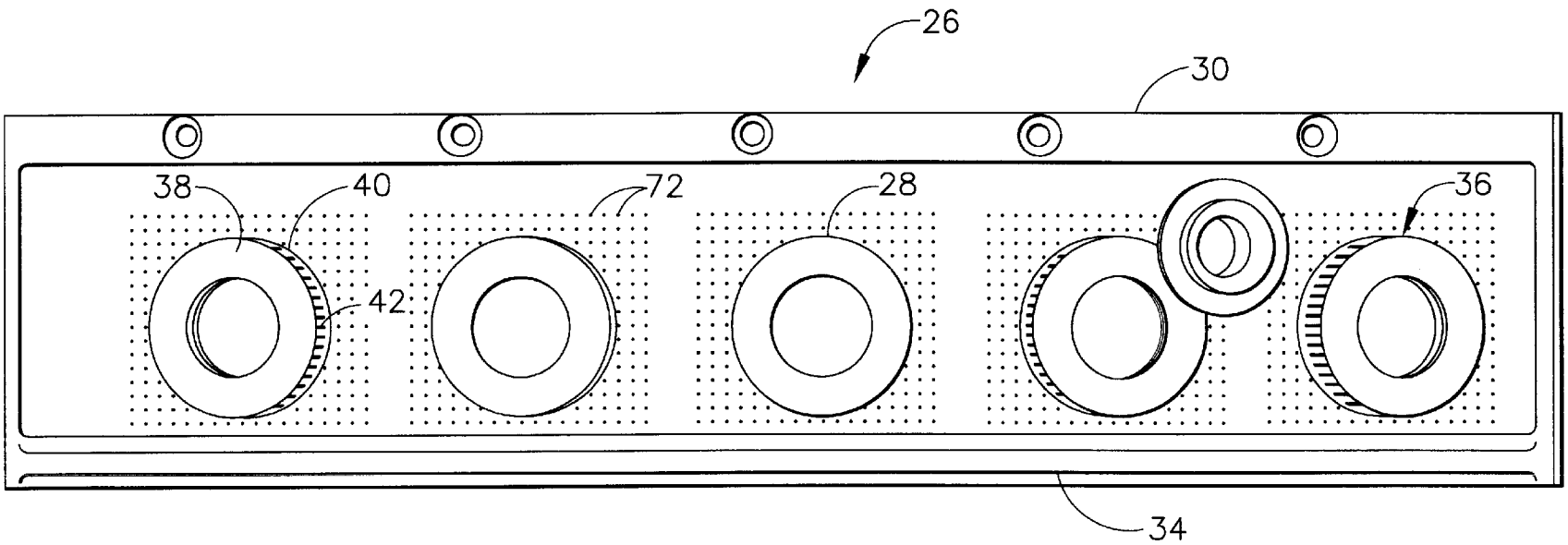
FIG. 3 is a partial top view of the combustor depicted in FIGS. 1 and 2 taken along line 3—3 of FIG. 2, where the fuel air mixer has been omitted for clarity.
Figure 4:
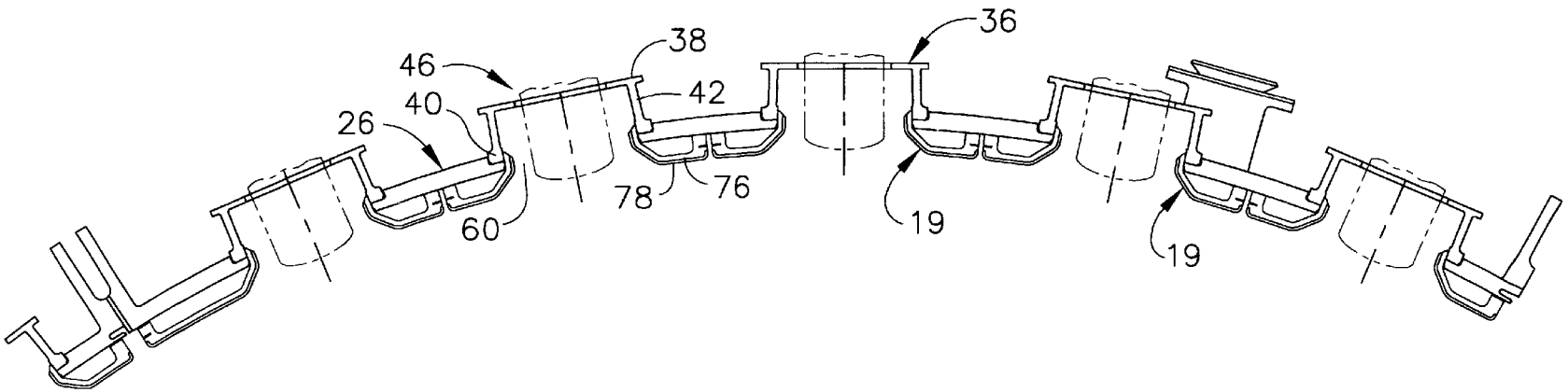
FIG. 4 is a partial aft view of the pilot dome portion of the combustor depicted in FIGS. 1–3, where the fuel air mixers have been omitted for clarity.
Figure 5:
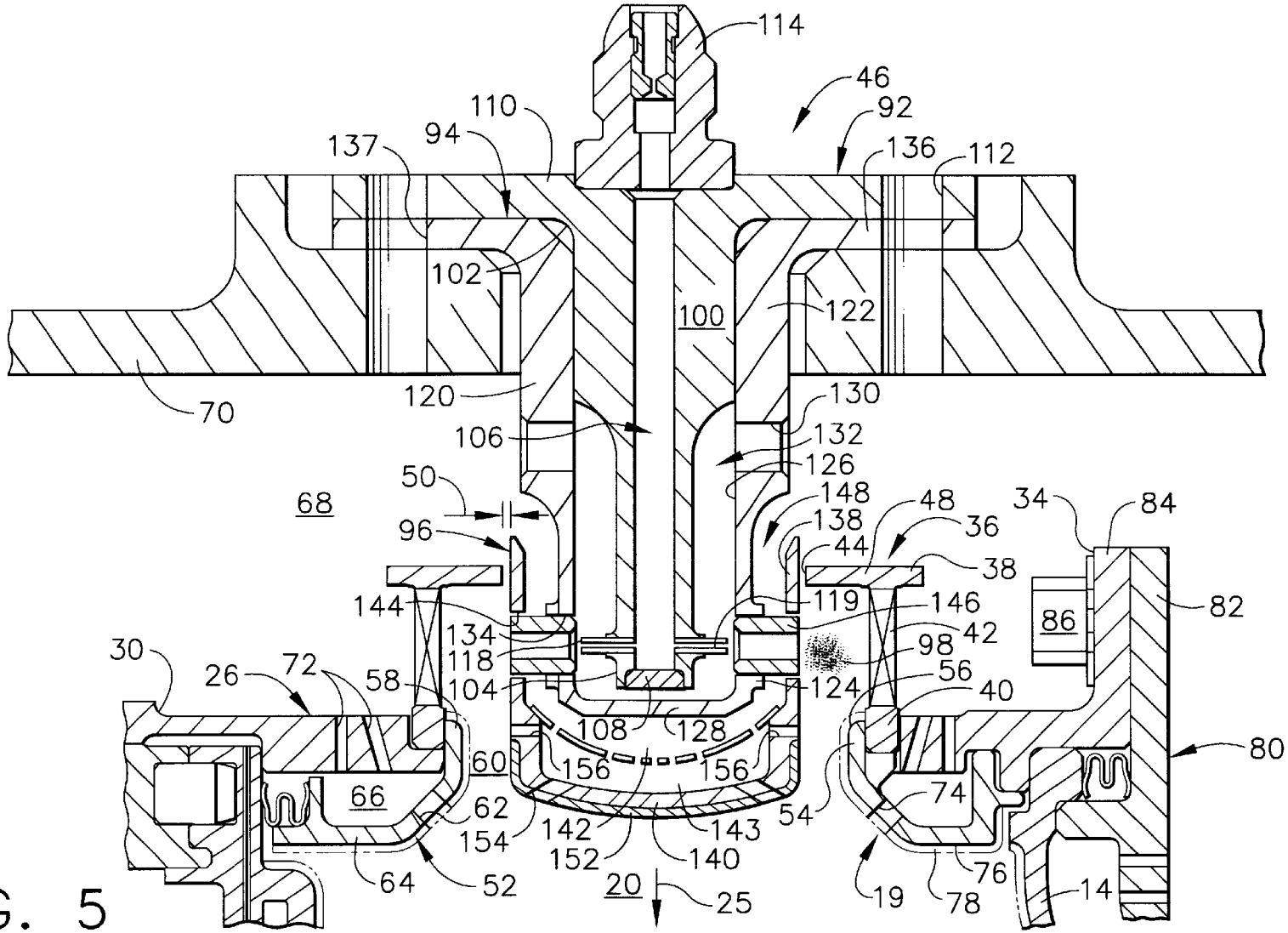
FIG. 5 is an enlarged, cross-sectional view of the pilot dome and fuel air mixer depicted in FIGS. 1–4; and, FIG. 6 is a top schematic view of the interaction between the radial vortex flow of the pilot dome and the axial flow injected into the main dome depicted in FIG. 1.

More specifically, it will be seen from FIGS. 3 and 4 that a plurality of first dome segments 19 are circumferentially spaced around longitudinal axis 12 so that each one is directed radially inward with respect to such longitudinal axis 12. The structure of first dome segments 19 includes a substantially ring-shaped impingement baffle 26 having a plurality of circumferentially spaced openings 28 formed therein. As seen in FIGS. 2 and 5, impingement baffle 26 is connected at an upstream end 30 to an assembly including dome plate 22 and an outer cowl 32 located upstream of dome plate 22. Impingement baffle 26 is connected at a downstream end 34 to outer liner 14 in a manner to be detailed hereinafter.

Each of first dome segments 18 further includes a substantially ring-shaped swirler assembly, indicated generally by reference numeral 36, which is positioned in alignment with and radially outside each impingement baffle opening 28. As best seen from FIGS. 3–5, each swirler assembly 36 preferably has an outer ring portion 38, an inner ring portion 40 connected to impingement baffle 26, and a plurality of swirler members 42 located between outer and inner ring portions 38 and 40. With respect to outer ring portion 38, it will be appreciated that an inner annular surface 44 thereof defines the opening through which a fuel air mixer 46 is inserted in position for first dome segment 19. Accordingly, outer ring portion 38 preferably has a flange portion 48 which extends radially inward toward axis 25 and is sized so as to permit a minimal gap 50 (see FIG. 5) with fuel air mixer 46. Gap 50 not only accounts for thermal growth of outer ring portion 38 and fuel air mixer 46, but movement of first dome 18 relative to outer casing 70. Gap 50 also allows air to be injected therethrough which assists in blowing out a recirculation zone bounded by outer ring portion 38, swirlers 42, and fuel air mixer 46.

Another major structural component of each first dome segment 19 is a substantially ring-shaped liner segment 52 positioned in alignment with and radially inside impingement baffle opening 28. It will be appreciated from FIG. 5 that liner segments 52 essentially define first dome 18. Accordingly, each liner segment 52 preferably has a curvilinear cross-section which is frusto-conical in nature. More specifically, liner segment 52 preferably has a first end 54 which is brazed or otherwise connected to an inner surface 56 of inner ring portion 40. A first liner segment portion 58 extends substantially parallel to axis 25 so as to define a throat area 60 with fuel air mixer 46. It will be noted that first portion 58 is radiused so as to permit better flow from swirlers 42 and not expose a sharp edge thereto. Thereafter, a second portion 62 of liner segment 52 extends radially inward toward longitudinal axis 12 and away from first dome axis 25. A third portion 64 of liner segment 52 then extends substantially perpendicular with respect to axis 25 where it is then connected to dome plate 22 and outer liner 14.

In this way, a substantially annular cavity 66 is formed between liner segment 52 and impingement baffle 26. It will be understood that cavity 66 is in flow communication with an air supply to an outer annular passageway 68 defined principally by an outer casing 70 and outer liner 14 by means of cooling holes 72 formed in impingement baffle 26. Openings 74 formed in liner segment 52, preferably within second portion 62 thereof, then provide additional air flow to further lower the fuel-air ratio of premixture 98 entering first combustion zone 20 which helps to further reduce NOx emissions. In this same regard, it is preferred that an inner surface 76 of liner segment 52 be provided with thermal barrier coating as indicated by reference numeral 78 in order to protect liner segment 52 against the hot temperatures experienced within first combustion zone 20.

It will also be appreciated that a substantially annular impingement baffle 80 (best seen in FIG. 2) is preferably provided which is connected at a first end 82 to a downstream flange 84 of impingement baffle 26 by means of a bolt 86 or other mechanical connection and at a second end 88 to a turbine inlet flange 90. Impingement baffle 80 is configured so as to interface with a forward end of outer liner 14, whereby it is able to provide damping for axial movement by first dome 18 and outer liner 14.

As indicated hereinabove, fuel air mixers 46 are provided within each impingement baffle opening 28 so as to be aligned along axis 25 of each first dome segment 19. Although other configurations of fuel air mixers may be utilized, it is preferred that fuel air mixers 46 have a design like that described in a patent application entitled "Fuel Air Mixer For Radial Dome Of Gas Turbine Engine Combustor," filed concurrently herewith by the assignee of the present invention, having Ser. No. 09/398,559 and hereby incorporated by reference.

It will be seen from FIG. 5 that fuel air mixer 46 preferably includes a fuel injection assembly 92, a mixer assembly 94, and a heat shield 96 which work in concert to provide a fuel air mixture 98 to first dome 18 while maintaining desired air flow therefrom to assist in cooling and preventing boundary conditions from forming. More specifically, fuel injection assembly 92 includes an elongated fuel stem 100 which extends along axis 25 from a first end 102 to a second end 104 and has a passage 106 therein. It will be noted that the diameter of fuel stem 100 is reduced at about a midpoint thereof to second end 104, where an end wall 108 is provided adjacent second end 104 so as to terminate passage 106. Further, a flange portion 110 extends radially outward from axis 25 adjacent first end 102 thereof and includes a plurality of openings 112 therein. A fuel inlet 114 is provided adjacent first end 102 of fuel stem 100 which is in flow communication with passage 106. It will be understood from FIG. 1 that fuel inlet 114 is connected to a fuel supply 116. A plurality of fuel injectors 118 are positioned within corresponding radial openings 119 located adjacent second end 104 of fuel stem 100, wherein fuel injectors 118 are in flow communication with passage 106. Accordingly, fuel enters fuel air mixer 46 at fuel inlet 114, flows through passage 106 until it is injected radially through fuel injectors 118, is mixed with an air flow through swirlers 42, and provided to first dome 18 as premixture 98.

Mixer assembly 94 includes an elongated mixer tube 120 which extends from a first end 122 to a second end 124 and forms a cavity 126 in conjunction with an end wall 128. It will be appreciated that mixer tube 120 is configured so that cavity 126 is able to receive a majority of fuel stem 100 therein. Further, a first plurality of openings 130 are formed in mixer tube 120 approximately midway the length thereof for receiving air flow supplied to outer annular passageway 68. Openings 130 are in flow communication with an annular passage 132 formed by fuel stem 100 and mixer tube 120 which supplies air to the fuel injected by fuel injectors 118. Of course, a second plurality of openings 134 are provided in mixer tube 120 adjacent second end 124 thereof, where such openings 134 are aligned with fuel injectors 118 when fuel stem 100 is positioned in mixer tube 120. It will further be seen that a flange portion 136 extends radially out from mixer tube 120 adjacent first end 122 and is configured so that fuel stem flange portion 110 lies in substantially abutting relation therewith. A plurality of openings 137 are provided in flange portion 136 which may be aligned with openings 112 in fuel stem flange portion 110.

Heat shield 96 is preferably attached to a lower portion of mixer tube 120 and includes a substantially annular wall 138 with an end wall 140 located across a bottom of annular wall 138 so as to form a cavity 142 therein. It will be seen in FIG. 5 that a plurality of openings 144 are formed therein in a position so that they align with second openings 134 of mixer tube 120. Heat shield 96 and mixer tube 120 are then preferably connected by means of a plurality of tubes 146 inserted through openings 134 and 144. Tubes 146 are then brazed to heat shield openings 144, but left to form a slip joint with mixer tube openings 134 to allow for movement of mixer tube 120. It will be appreciated that tubes 146 are positioned so as to align with fuel injectors 118, and although not shown, fuel injectors 118 may be positioned within tubes 146. Air entering through openings 130 and traveling down annular passage 132 then exits through tubes 146 and mixes with the fuel provided by injectors 118.

A flow passage 148 is formed by annular wall 138 of heat shield 96 and a portion of mixer tube 120, where flow passage 148 is in flow communication with air flow provided to outer annular passageway 68 so as to provide air to cavity 142. An impingement baffle 150 is preferably provided within cavity 142 so as to meter the air flow to end wall 140. In this way, the air flow into cavity 142 is able to assist in cooling heat shield end wall 140, although end wall 140 preferably includes a thermal barrier coating applied thereto as indicated by reference numeral 152. It will also be seen that a plurality of openings 154 are formed in end wall 140 to release spent cooling air from a cavity 143 in flow communication with cavity 142. The spent cooling air is injected into first combustion zone 20, where it improves mixing, helps prevent flashback into throat area 60, and lowers the fuel-air ratio of premixture 98 entering first combustion zone 20. Additional openings 156 may be provided within a portion of annular wall 138 (preferably below impingement baffle 150) so as to improve fuel/air mixing through throat area 60.

In order for fuel air mixers 46 to be properly aligned with each impingement baffle opening 28, they are preferably connected to outer casing 70 by means of a mechanical connection with flange portions 110 and 136 of fuel stem 100 and mixer tube 120, respectively. This is accomplished by means of bolts 158 or other similar devices provided in the aforementioned plurality of openings 112 and 137 formed in flange portions 110 and 136. Because openings 112 and 137 are typically provided in symmetrical relation about their respective flange portions, an additional opening 160 and 162 is formed in flange portions 110 and 136 so as to ensure proper alignment and orientation of openings 134 and fuel injectors 118 (see FIG. 4 of the '559 patent application). Alternatively, fuel stem 100 and mixer tube 120 may be manufactured with the same number of bolt openings as openings 134 and fuel injectors 118, and be positioned in the same respective circumferential locations.

As indicated hereinabove, a mixture of fuel and air is provided axially through dome plate 22 into second combustion zone 20 during moderate and high operation levels. This is preferably accomplished by a plurality of fuel air mixers 164 positioned upstream of dome plate 22. It will be understood from FIGS. 1 and 2 that a plurality of substantially linear tubes 166 are spaced radially and circumferentially around dome plate 22 so as to be arranged in rows and columns, respectively. Each tube 166 has an upstream end 168 and a downstream end 170, wherein downstream end 170 is positioned in alignment with an opening 172 in dome plate 22 and a fuel injection assembly 174 is positioned so as to provide fuel to the upstream end 168. In this way, flexibility is built into combustor 10 whereby designated rows and/or columns of fuel air mixers may be provided fuel. It will be appreciated that the fuel air mixture flowing into second combustion zone 20, represented by arrows 176 are substantially parallel to longitudinal axis 12 and preferably unswirled. Fuel injection assembly 174 is in flow communication with an appropriate fuel supply as described in a patent application entitled "Fuel Injection Assembly For Gas Turbine Engine Combustor," having Ser. No. 09/398,558, filed concurrently herewith, and hereby incorporated by reference. Of course, fuel air mixers 164 may be modified so as to be oriented at an angle to longitudinal axis 12 and/or provide swirl to the fuel air mixture 176 flowing therethrough. In this way, flexibility is built into combustor 10 whereby designated rows and/or columns of fuel air mixers may be provided fuel. It will be appreciated that the fuel air mixture flowing into second combustion zone 20, represented by arrows 176, are substantially parallel to longitudinal axis 12 and preferably unswirled. Fuel injection assembly 174 is in flow communication with an appropriate fuel supply as described in a patent application entitled "Fuel Injection Assembly For Gas Turbine Engine Combustor," having Ser. No. 09/398,558, filed concurrently herewith, and hereby incorporated by reference. Of course, fuel air mixers 164 may be modified so as to be oriented at an angle to longitudinal axis 12 and/or provide swirl to the fuel air mixture 176 flowing therethrough.

In operation, combustor 10 of the present invention has a multi-stage function in which first dome 18 acts as a pilot. Accordingly, fuel is supplied to at least some first dome segments 19 during all phases of combustor operation. It is noted that this is particularly important during low power and idle conditions, as fuel is not provided to fuel air mixers 164 during such time. For moderate to high power conditions, fuel is provided to at least some of fuel air mixers 164 so that fuel air mixture 176 is injected into second combustion zone 24. Since combustor 10 involves multiple stages of operation, has a radially oriented dome 18, and has an axial dome plate 22, it is known as a multi-stage radial axial combustor (MRA).

Figure 6:
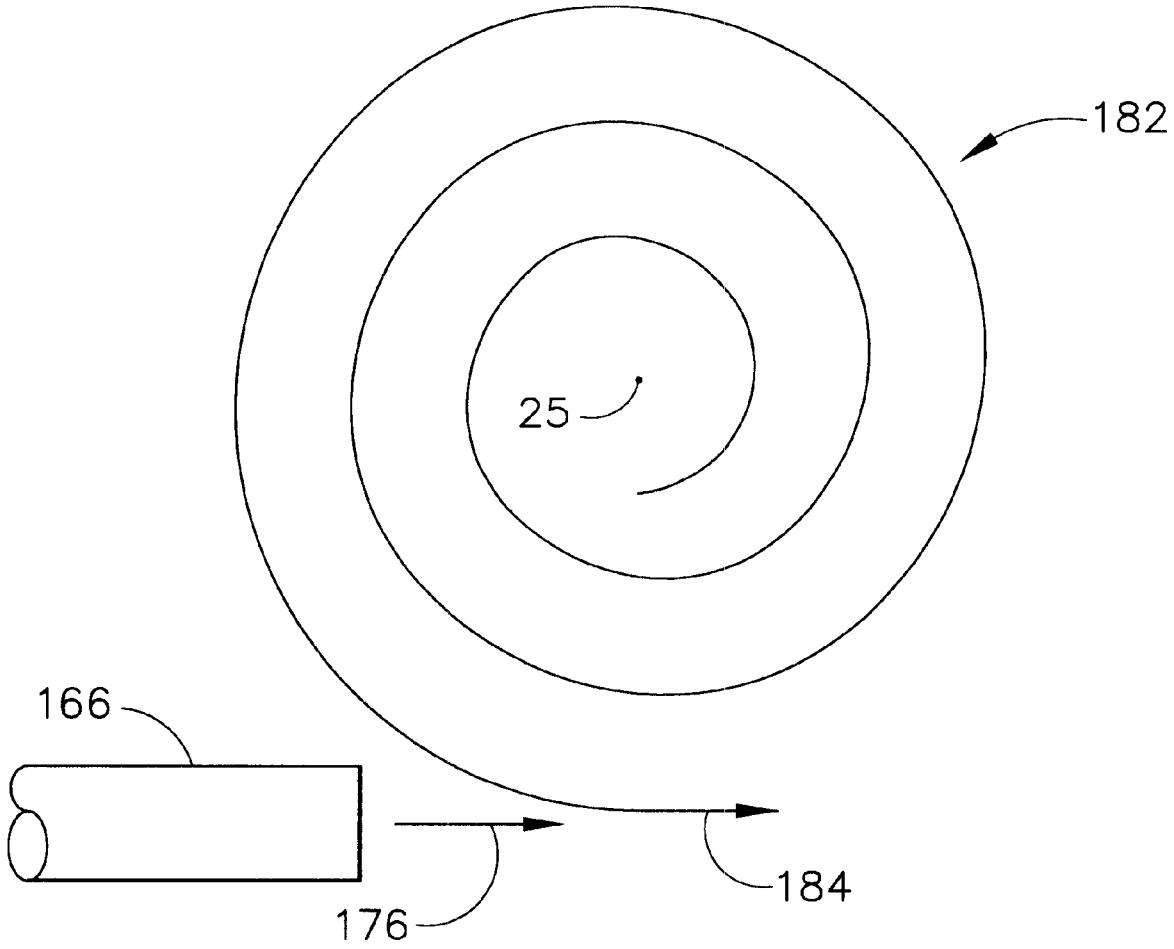

With respect to the flow of fuel air mixtures 98 and 176, respectively, it will be appreciated that a separate vortex flow 182 is created in each first combustion zone 20 by the swirling action created from air injected through swirlers 42. Vortex flow 182, which is depicted schematically in FIGS. 1 and 6, moves radially inward with respect to longitudinal axis 12 toward second combustion zone 24. Axis 25 through each first dome segment 19 also serves as an axis through vortex flow 182 and is substantially parallel to dome plate 22. It will be appreciated that maintaining the strength of vortex flow 182 as it extends immediately downstream of dome plate 22 and mixes with axial fuel air mixtures 176 injected into second combustion zone 24 is a primary concern (note the overall tapering of vortex flow 182, indicated by outline 185, as it extends radially inward). Thus, fuel air mixtures 176 are intentionally aligned with an aft component 184 of vortex flow 182 (see FIG. 6). Given the difference in velocity of vortex flow 182 and axial fuel air mixtures 176, the spacing and timing of such flows are critical. It has been found, however, that the mixing which occurs within second combustion zone 24 is effective for creating a highly desirable flow field which produces extremely low levels of emissions.

Having shown and described the preferred embodiment of the present invention, further adaptations of the combustor deflector plate and the process for manufacturing it can be accomplished by appropriate modifications by one of ordinary skill in the art without departing from the scope of the invention.

What is claimed is:

1. A combustor for a gas turbine engine having a longitudinal axis therethrough, comprising:

(a) an outer liner having a forward end and an aft end;

(b) an inner liner having a forward end and an aft end;

(c) a pilot dome formed upstream of said outer liner forward end so as to define a first combustion zone radially oriented to said longitudinal axis;

(d) a dome plate having an outer portion connected to an upstream end of said pilot dome and an inner portion connected to said inner liner forward end, wherein a main combustion zone is defined by said dome plate, said outer liner, and said inner liner substantially perpendicular to said first combustion zone;

(e) a plurality of circumferentially spaced fuel air mixers positioned with respect to a corresponding segment of said pilot dome so as to provide a fuel air mixture into said first combustion zone;

wherein said fuel air mixture through said pilot dome is provided continuously into said first combustion zone during operation of said combustor.

2. The combustor of claim 1, wherein said pilot dome is positioned axially downstream of said dome plate.

3. The combustor of claim 1, each said fuel air mixer being retained in position with respect to said pilot dome segment by means of a connection to a casing positioned in radially spaced relation to said pilot dome and said outer liner.

4. The combustor of claim 1, firer comprising a fuel supply in flow communication with said fuel air mixers located within said pilot dome segments.

5. The combustor of claim 1, wherein said fuel air mixture flowing into said first combustion zone is substantially perpendicular to said longitudinal axis.

6. The combustor of claim 1, wherein said fuel air mixture flowing into said first combustion zone is swirled so as to create a vortex flow in said first combustion zone which moves radially inward to said main combustion zone.

7. The combustor of claim 6, wherein an outline of said vortex flow is tapered smaller as it extends radially inward.

8. The combustor of claim 6, wherein an axis through said vortex flow is oriented substantially parallel to said dome plate.

9. The combustor of claim 6, wherein a flow through said dome plate is aligned with an aft component of said vortex flow in said main combustion zone so as to increase the strength of said vortex flow.

10. The combustor of claim 9, wherein a radial velocity of said vortex flow into said main combustion zone is less than an axial velocity of said flow through said dome plate.

11. A combustor for a gas turbine engine having a longitudinal axis therethrough, comprising:

(a) an outer liner having a forward end and an aft end;

(b) an inner liner having a forward end and an aft end;

(c) a first dome formed upstream of said outer liner forward end so as to define a a first combustion zone radially oriented to said longitudinal axis;

(d) a dome plate having an outer portion connected to an upstream end of said first dome and an inner portion connected to said inner liner forward end, wherein a second combustion zone is defined by said dome plate, said outer liner, and said inner liner substantially perpendicular to said first combustion zone; and (e) a plurality of fuel air mixers positioned upstream of said dome plate for providing a fuel air mixture into said second combustion zone, said fuel air mixers flier comprising:

(1) a plurality of substantially linear tubes arranged in rows and columns, each tube including an upstream end and a downstream end, wherein said downstream end is positioned within an opening in said dome plate; and (2) a fuel injection assembly positioned within said tube upstream end.

12. The combustor of claim 11, wherein said fuel air mixture flowing into said second combustion zone through said dome plate is unswirled.

13. The combustor of claim 11, wherein said fuel air mixture flowing into said second combustion zone through said dome plate is substantially parallel to said longitudinal axis.

14. The combustor of claim 11, wherein said fuel air mixture through said dome plate is provided into said second combustion zone only during predetermined stages of operation for said combustor.

15. The combustor of claim 11, wherein a fuel air mixture is provided through tubes of only a designated row.

16. The combustor of claim 11, wherein a fuel air mixture is provided through tubes of only a designated column.

17. The combustor of claim 11, further comprising a fuel supply in flow communication with said fuel air mixers located upstream of said dome plate.

18. A combustor for a gas turbine engine having a longitudinal axis therethrough, comprising:

(a) an outer liner having a forward end and an aft end;

(b) an inner liner having a forward end and an aft end;

(c) a first dome formed upstream of said outer liner forward end so as to define a a first combustion zone radially oriented to said longitudinal axis, said first dome further comprising an assembly including:

(1) a substantially ring-shaped impingement baffle having a plurality of circumferentially spaced openings formed therein;

(2) a substantially ring-shaped swirler assembly positioned in alignment with and radially outside each impingement baffle opening; and (3) a substantially ting-shaped liner segment positioned in alignment with and radially inside each impingement baffle opening, wherein an inner surface of said liner segment defines a segment of said first dome; and (d) a dome plate having an outer portion connected to an upstream end of said first dome and an inner portion connected to said inner liner forward end, wherein a second combustion zone is defined by said dome plate, said outer liner, and said inner liner substantially perpendicular to said first combustion zone;

wherein said impingement baffle is connected at an upstream end to said dome plate and at a downstream end to said outer liner forward end.

19. The combustor of claim 18, each said swirler assembly further comprising:

(a) an outer ring portion having a flange portion extending inward from said impingement baffle opening;

(b) an inner ring portion connected to said impingement baffle and said liner segment; and (c) a plurality of swirlers located between said outer and inner rings oriented toward said impingement baffle opening.

20. The combustor of claim 18, each said liner segment having a curvilinear shape in cross-section so as to form a substantially annular cavity with said impingement baffle, said cavity being in flow communication with an air supply to a passageway defined by an outer casing and an outer annular portion of said combustor.

21. The combustor of claim 20, each said liner segment further comprising a plurality of openings formed therein so as to provide air flow to said first combustion zone.

22. The combustor of claim 21, said impingement baffle including a plurality of cooling holes in flow communication with said air supply and said cavity.

23. The combustor of claim 21, wherein said liner segment openings are oriented so as to provide air flow at an angle to an axis through said first dome.

24. The combustor of claim 18, wherein said liner segment inner surfaces are provided with thermal barrier coating.

25. The combustor of claim 18, further comprising a substantially annular second impingement baffle connected at a first end to said impingement baffle downstream end and said outer liner forward end and at a second end to a turbine inlet plate at a second end so as to provide stability against undue axial movement by said first dome and said outer liner.

26. The combustor of claim 18, wherein a gap is maintained between said swirler assembly and a fuel air mixer provided in alignment with each said baffle opening.

* * * * *